US006138309A

United States Patent [19]

Tadros et al.

[11] Patent Number: 6,138,309

[45] Date of Patent: Oct. 31, 2000

[54] TENSION MEMBERS FOR ERECTING STRUCTURES

[75] Inventors: Maher K. Tadros; Christopher Y. Tuan, both of Omaha, Nebr.

[73] Assignee: Board of Regents of University of Nebraska, Lincoln, Nebr.

[21] Appl. No.: 08/988,140

[22] Filed: Dec. 10, 1997

[51] Int. Cl.[7] ..... E01D 4/00

[52] U.S. Cl. ..... 14/25; 14/22; 14/24; 29/897.3

[58] Field of Search ..... 52/223, 721, 223.12, 52/223.14, 738.1, 309.15, 309.17, 721.4, 723.1, 724.5, 223.4; 29/897.3, 897.34; 14/13, 22, 25, 23, 24

[56] References Cited

U.S. PATENT DOCUMENTS

| | | | |
|---|---|---|---|
| 536,680 | 4/1895 | Avery | 14/13 |
| 1,334,881 | 3/1920 | Bennett | 52/223.4 |
| 1,602,828 | 10/1926 | Lally | 52/721.4 |
| 2,418,312 | 4/1947 | Michelman | 28/897.3 |
| 2,677,957 | 5/1954 | Upson | 52/223.14 |
| 3,347,005 | 10/1967 | Preston | 52/721 |
| 4,633,540 | 1/1987 | Jungwirth et al. | 14/22 |
| 4,999,959 | 3/1991 | Virtanen | 52/223 |
| 5,457,929 | 10/1995 | Kim | 52/721.4 |
| 5,599,599 | 2/1997 | Mirmiran et al. | 52/309.15 |

*Primary Examiner*—Eileen D. Lillis
*Assistant Examiner*—Raymond W Addie
*Attorney, Agent, or Firm*—Shook, Hardy & Bacon L.L.P.

[57] ABSTRACT

A tension member is provided for use in erecting structures that has an elongated body with an outer wall defining an inner space. A tendon extends from one end of the body to the other within the defined inner space. The tendon has a tension force placed upon it. Concrete material is added to the inner space to form a concrete holding member which surrounds the tendon and which is in turn surrounded by the outer wall. The concrete holding member thus contacts the tendon and, upon curing, maintains the tension force placed upon the tendon. The tension member is placed in compression when the tension force is released from the tendon. In another aspect of the present invention, an arch member is provided for use as a compression member in a bridge. The arch member has an elongated arcuate body with an outer wall defining an inner space. The inner space of the body is filled with a concrete so that the body provides support for the concrete.

6 Claims, 4 Drawing Sheets

Fig.5.
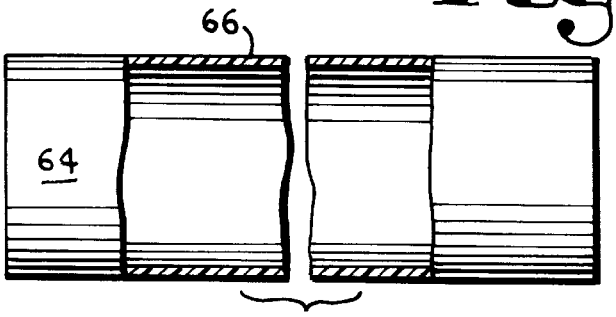
Fig.7.
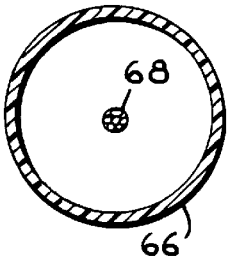
Fig.6.
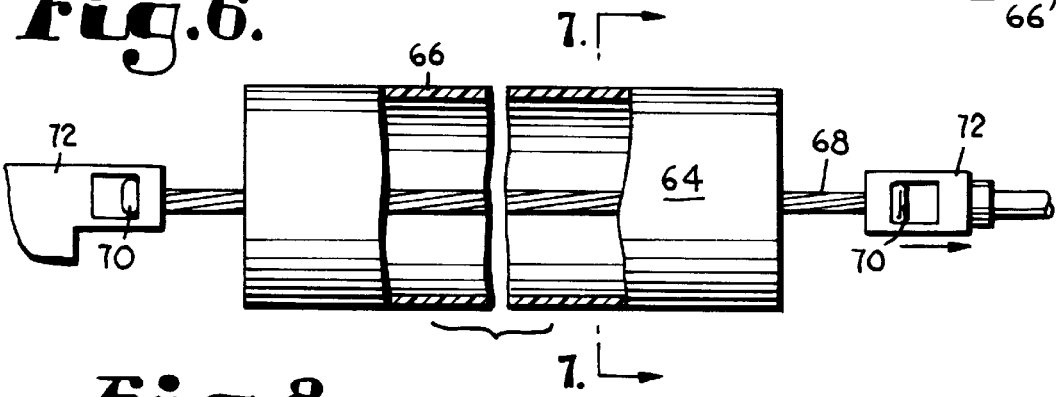
Fig.8.
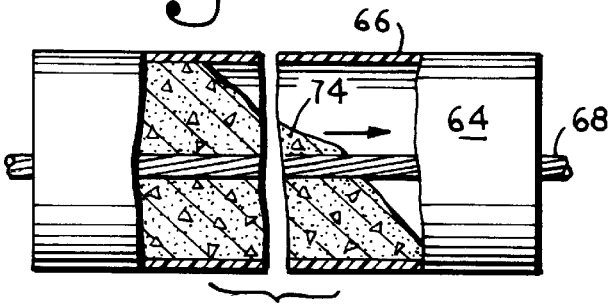
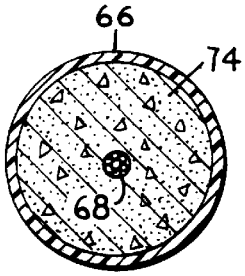
Fig.10.
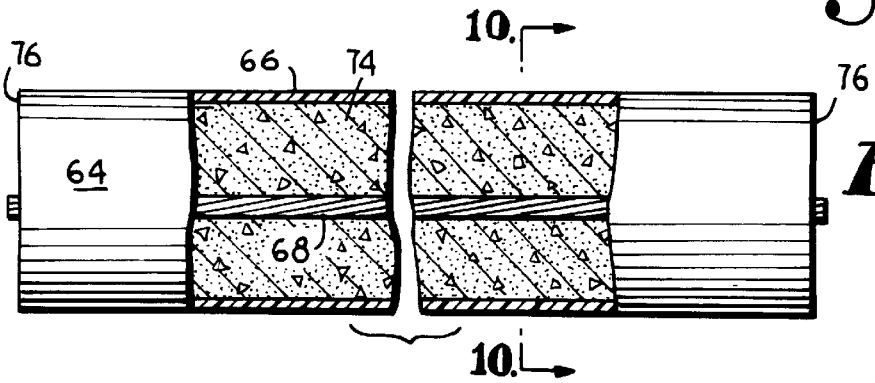
Fig.9.

TENSION MEMBERS FOR ERECTING STRUCTURES

BACKGROUND OF THE INVENTION

This invention relates to tension members for erecting structures, and more specifically, to tension members for use in bridge building.

Mankind has used bridges of many types for hundreds of years to span streams, rivers, valleys etc. There are three basic types of bridges in use today—beam bridges, suspension bridges and arch bridges. Beam bridges are also known as girder bridges and simply rest on a number of supports. Suspension bridges utilize cables which are in tension and which exert a pull on their end abutments or supports. Finally, arch bridges utilize an arched compression member which thrusts outwardly on the end abutments. In the arch bridge design, as with other designs, however, both compression ad tension members are present in the construction. Further, the three basic types of bridges may be varied and combined to form different designs and construction. One variation is the cable-stayed bridge, which is currently popular in Japan and Europe. The cable-stayed bridge uses girders extending between vertical concrete pylons. The pylons extend vertically upwardly from the traveling deck of the bridge and are used to support a number of spaced apart cable stays. One end of the cable stays is secured to the pylons and the opposite end of the cable stays is secured to the deck, thus providing additional support for the deck.

In cable-stayed bridges, the cables stay currently in use are steel strands which are coated with a thin protective coating. The stays are prestressed to a known amount. It has been reported, however, that the cable stays currently in use are susceptible to fatigue failure due to vibrations caused by wind as well as traffic loads. In addition, sagging of cable stays under gravity loads may take place. Thus, an alternative tension member is needed that will overcome these drawbacks.

Further, in erecting structures, and particularly bridges, the choice of building materials is largely between steel and concrete. This distinction is not absolute, however, because nearly all concrete bridges include a large amount of steel as reinforcement, and the majority of steel bridges have concrete bridges.

In selecting between materials, the cost of materials as well as their load bearing characteristics are considered. Concrete is typically the cheapest serviceable material for the job and has good compressive strength characteristics. On the other hand, steel is substantially more expensive but has increased tensile strength as compared to concrete Because of these characteristics, concrete is typically used for members in compression and steel is typically used for members in tension. The disadvantage of concrete is its low tensile strength, which often necessitates the addition of reinforcement members, typically made of steel. Thus, the use of reinforced concrete in bridges dates to the later 1800s.

An alternative method of reinforcing concrete to increase its tensile strength involves stretching the reinforcement members before concrete is poured around them. When the stretching force is related from the reinforcement members, the resulting reinforced concrete member is prestressed by an equivalent compression. The reinforced concrete member will thereafter have an increased resistance to tension up to the point at which the added load exceeds the amount of prestressing force. Thus, it is known to increase the tensile strength of concrete by using prestressed reinforcing members. However, there remains a need for economically further increasing the tensile strength of the concrete members used in erecting structures such as bridges.

As stated above, concrete members used in erecting structures are known for their compressive strength characteristics. In building bridges, concrete members are used as compression members. While these concrete members have good compressive strength, there does exist a need for compression members that have greater compressive strength characteristic than provided by concrete members alone. To address this need, existing concrete columns in buildings have been retrofitted with a surrounding steel jacket. The jacket provides increased compressive strength characteristics to the overall member by providing a body which resists the lateral expansion exerted by compressive forces on the concrete. However, this technology has been limited to erecting buildings and has been used in earthquake prone regions of the world.

Therefore, a compression member for a bridge which takes advantage of the increased compressive strength and ductility of concrete by confining the lateral expansion of the concrete with a surrounding body made of steel or other material is needed for use in the bridge building industry. Still further, a tension member for use in bridge construction is needed that increases the tensile strength characteristics of a concrete member by incorporating high strength prestressing tendons, and steel tubing around the concrete which have superior tensile strength characteristics. Further yet, an alternative tension member is needed for use in a cable-stayed bridge construction that is less susceptible to fatigue failure caused by wind and vibration and that is less susceptible to sagging.

SUMMARY OF THE INVENTION

One object of the present invention is to provide a compression member for a bridge that takes advantage of the increased compressive strength and ductility of concrete by confining the lateral expansion of the concrete with a surrounding body made of steel or other material.

A further object of the present invention is to provide a novel tension member for use in bridge construction with increased tensile strength characteristics which takes advantage of a prestressed concrete member by confining the lateral expansion of the prestressed concrete member.

According to one aspect of the present invention a tension member is provided for use in erecting structures. The tension member has an elongated body with an outer wall defining an inner space. A tendon extends from one end of the body to the other within the defined inner space. The tendon has a tension force placed upon it. Concrete material is added to the inner space to form a concrete holding member which surrounds the tendon and which is in turn surrounded by the outer wall. The concrete holding member thus contacts the tendon and, upon curing, maintains the tension force placed upon the tendon. The tension member is placed in compression when the tension force is released from the cable. In another aspect of the present invention, an arch member for use as a compression member in a bridge is provided. The arch member has an elongated arcuate body with an outer wall defining an inner space. The inner space of the body is filled with concrete so that the body provides support for the concrete.

Additional objects, advantages, and novel features of the invention will be set forth in part in the description which follows and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

In the accompanying drawings which form a part of this specification:

FIG. 5 is an elevation view of a body of a tension or compression member according to the principles of the present invention prior to being filled with concrete, and with parts being broken away to show particular details of construction;

FIG. 6 is a view of a tension member similar to FIG. 5, shown with a cable extending through the body and with tension applying means connected to the cable;

FIG. 7 is a sectional view taken along line 7—7 of FIG. 6;

FIG. 8 is a view similar to FIG. 6, shown with concrete being added to the interior of the body;

FIG. 9 is a view similar to FIG. 8 with concrete extending completely through the body;

FIG. 10 is a sectional view taken along line 10—10 of FIG. 9;

DETAILED DESCRIPTION OF THE PREFERRED EMBODIMENT

Figure 1:
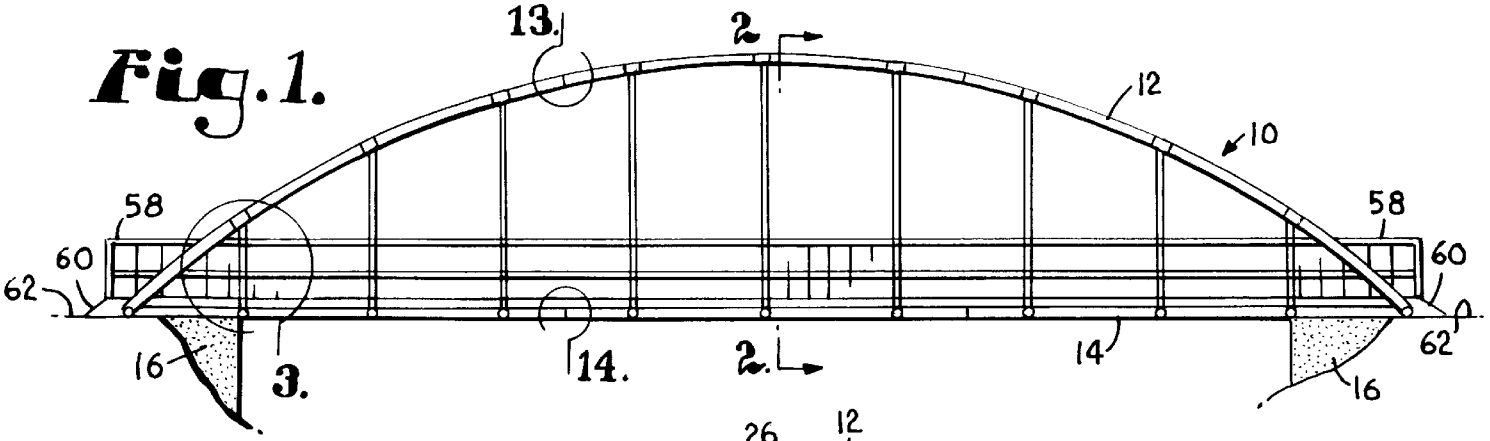
FIG. 1 is an elevation view of an arch bridge utilizing tension and compression members according to the principles of the present invention.

An arch bridge utilizing tension and compression members embodying the principle of this invention is broadly designated in the drawings by the reference numeral 10. As shown in FIG. 1, bridge 10 is an arch bridge, it being understood that other bridge types and building structures could utilize the tension and compression members described hereinafter. Arch bridge 10 is used to allow vehicle or pedestrian travel across a river, valley, ravine or the like. Bridge 10 has a pair of arcuate compression members 12 and a pair of extending, spaced-apart parallel tension members 14. Compression members 12 and tension members 14 may be constructed of shorter pieces, connected in series. Compression members 12 and tension members 14 terminate and are anchored within an abutment 16 as well known in the art.

Figure 3:
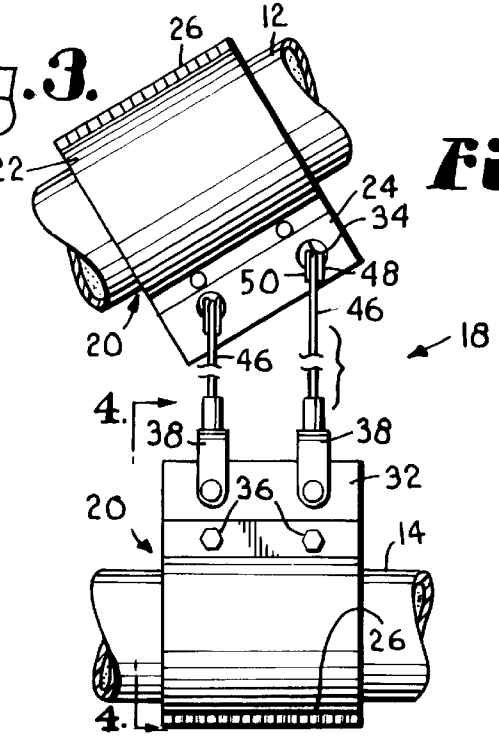
FIG. 3 is an enlarged view of the portion of FIG. 1 encircled by line 3 of FIG. 1.
Figure 4:
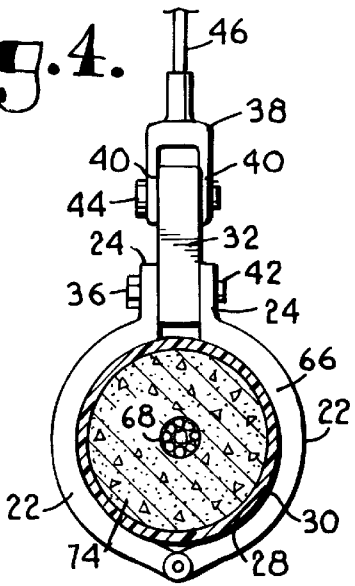
FIG. 4 is an enlarged sectional view taken along line 4—4 of FIG. 3.

As best seen in FIGS. 1 and 3, compression members 12 are coupled to tension members 14 through a coupling arrangement 18. Coupling arrangement 18 utilizes a pair of couplers 20 one of which is secured about tension member 14 and the other of which is secured about compression member 12. More specifically, each coupler 20 has a pair of arcuate brackets 22 with extending shoulders 24. Arcuate brackets 22 are hingedly secured together with hinge 26. Further, arcuate brackets 22 have a threaded inner surface 28 which engages a threaded outer surface 30 of compression member 12 and tension member 14, as is well known in the art. Arcuate brackets 22 are placed in abutting relationship with outer surface 30 of compression members 12 and tension members 14. As best seen in FIG. 4, shoulders 24 will be spaced from one another to accommodate a gusset plate 32. The lower end of gusset plate 32 has a pair of lower through holes which correspond with through holes 34 in shoulders 24. Arcuate brackets 22 are thus held in abutting relationship with compression members 12 and tension members 14 by securing bolts 36 through through holes 34 and the lower through holes in gusset plate 32. Arcuate brackets 22 are thus prevented from opening by bolts 36 and are prevented from axial movement along compression members 12 and tension members 14 through the abutting relationship of threaded inner surface 28 and threaded outer surface 30.

The upper end of gusset plate 32 has a pair of through holes extending therethrough which are used to couple a coupler head 38 to gusset plate 32. More specifically, coupler head 38 has a pair of extending, spaced apart arms 40. Arms 40 have through holes 42 extending therethrough which are placed in mating relationship with the upper through holes in gusset plate 32 and a connector 44 is placed through through holes 42 and the through holes in gusset plate 32 to couple coupler head 38 to gusset plate 32. Connector 44 can be a bolt, or other connecting means such as a rivet. Coupler head 38 is secured to a cable 46, which is typically a multi-strand cable coated with a protective material, such as epoxy.

The arrangement of arcuate brackets 22, gusset plate 32 and coupler head 38 may be used for both tension member 14 and compression member 12. Alternatively, a C-shaped clamp 48 may be disposed through through holes 34 in shoulders 24. Clamps 48 are formed with a groove 50 therein which is shaped to accommodate cable 46. Clamps 48 are rigid and secure arcuate brackets 22 in abutting relationship with threaded outer surface 30 of compression members 12 and tension members 14. In this use, cable 46 is placed through through holes 34 and rests within groove 50. A plurality of coupling arrangements 18 are similarly provided to connect compression members 12 with tension members 14.

Figure 2:
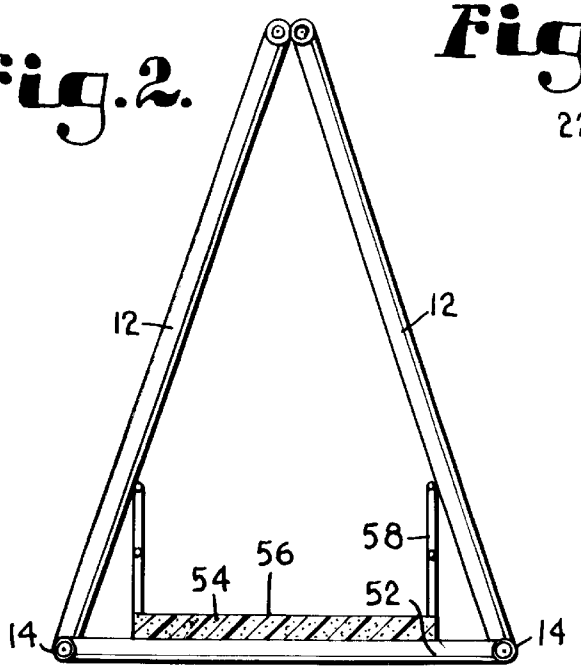
FIG. 2 is a sectional view taken along line 2—2 of FIG. 1.

As best seen in FIG. 2, extending between tension members 14 are a plurality of parallel, spaced apart cross-members 52. Cross-members 52 and compression members 12 form a triangular shape in cross section, with compression members 12 rigidly secured to one another at the top of the arch formed thereby. Typically, a cross member 52 is provided at or near each coupling arrangement 18 along tension members 14, and are coupled with tension members 14 as is known to those of skill in the art. Coupled to cross-members 52 is a deck 54 which provides bridge 10 with a traveling surface 56 upon which vehicles or pedestrians may travel. Extending upwardly from each side of deck 54 are protective railing 58. Railings 58 operate to discourage pedestrians and vehicles from inadvertently traveling beyond deck 54. Preferably, railings 58 extend beyond the arch formed by compression members 12 at either end thereof, as is best seen in FIG. 1. A transition ramp 60 is provided to transition from the initial traveling surface 62 to the traveling surface 56 of deck 54.

As described above, bridge 10 may be formed and erected using tension members 14 and compression members 12. In practice, tension members 14 and compression members 12 may be formed to be less than the total length needed. Thereafter, as many tension member 14 of compression members 12 as needed are coupled together to form the desired length member as is more fully described below. Turning now to FIG. 5, a body 64 is shown for forming compression members 12 and tension members 14. As shown in FIGS. 5 and 10, body 64 is a hollow cylindrical tube having an outer wall 66. However, other configurations of body 64 are also suitable. Body 64 is preferably made of steel or a fiber reinforced plastic (FRP) material. It has been found that outer wall 66 does not need to be of substantial thickness, and in fact, depending on the use, can be one-eighth of an inch thick. In forming tension members 14, a tendon 68 is disposed through the interior of body 64. Preferably, tendon 68 is centrally disposed in the interior of body 64 as is shown in FIG. 7. Tendon 68 can be high strength steel or FRP, with fibers usually of carbon, aramid, or fiberglass fibers. Connected to a pair of terminal ends 70 of tendons 68 are a pair of holding clamps 72. One holding clamp may be stationary while the other is connected to a tensioning means indicated generally by the arrow in FIG. 7. Alternatively, both holding clamps 72 may be connected to a tensioning means so that a tensioning force is imparted upon tendon 68. While the tension force is held on tendon 68 via holding clamps 72 and the tensioning means, a concrete material 74 is added to the interior of body 64 in a surrounding relationship with tendon 68. Concrete material 74 is added to body 64 to completely fill body 64 until material 74 is within a desired distance of each end 76 of body 64. To ensure that concrete material 74 does not extend beyond this point, a pair of end caps (not shown) may be placed within each end 76 until material 74 has cured or hardened. Body 64, filled with concrete material 74 and surrounding tendon 68 is seen in cross-section in FIG. 10. The tension force is held on tendons 68 until the concrete material has cured or hardened. Thereafter, the tensioning force may be related from tendon 68. Tendon 68 is prevented from inward axial movement by concrete material 74. Therefore, tension member 14 is prestressed in compression upon release of the tension force on tendon 68. Tension member 14 therefore has the combined benefits of increased tensile strength from prestressed concrete and increased tensile strength resulting from body 64 by confining the lateral expansion of concrete material 74. Tendon 68 is thereafter severed so that it does not substantially protrude from each end 76 of body 64, as best seen in FIG. 9.

Figure 11:
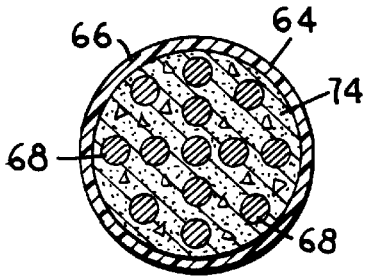
FIG. 11 is a sectional view, similar to FIG. 10, depicting an alternative embodiment of the tension member of the invention.

It should be understood that the type and size of tendon 68, the material and wall thickness of body 64, and the type of concrete material 74 used in tension member 14 can be adjusted depending on the end use of tension member 14, and the load bearing characteristics needed, as can be understood by one of ordinary skill in the art. Further, the number and pattern of tendons 68 may be adjusted as well. In one embodiment, shown in FIG. 11, the invention uses thirteen tendons 68, arranged in a pattern within body 64. Concrete material 74 surrounds tendons 68, as described above. More or less tendons 68 could of course be used, depending on the end use of the tension member and the load bearing characteristics needed.

Compression members 12, used in arch bridge 10, are formed in a similar fashion to tension members 14. However, compression members 12 do not have tendon 68 with a tension force thereon extending through body 64. Rather, concrete material 74 is simply added to the interior of body 64. Compression members 12 therefore have the benefits of good compressive strength of concrete increased by the support of body 64. Body 64 acts to confine the lateral expansion of concrete material 74. Body 64 itself does not carry any axial forces. Due to the lateral expansion of the concrete, tensile hoop stress will develop in the tube in the circumferential direction, and the lateral expansion of the concrete is effectively confined.

Figure 13:
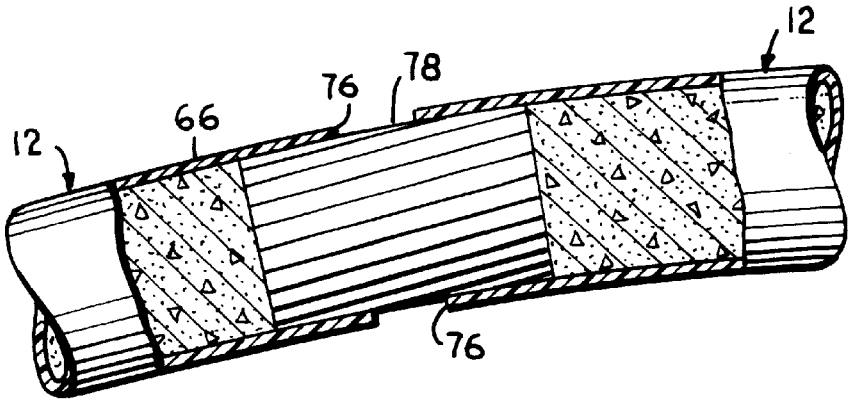
FIG. 13 is an enlarged view of the portion of FIG. 1 encircled by line 13 of FIG. 1.
Figure 14:
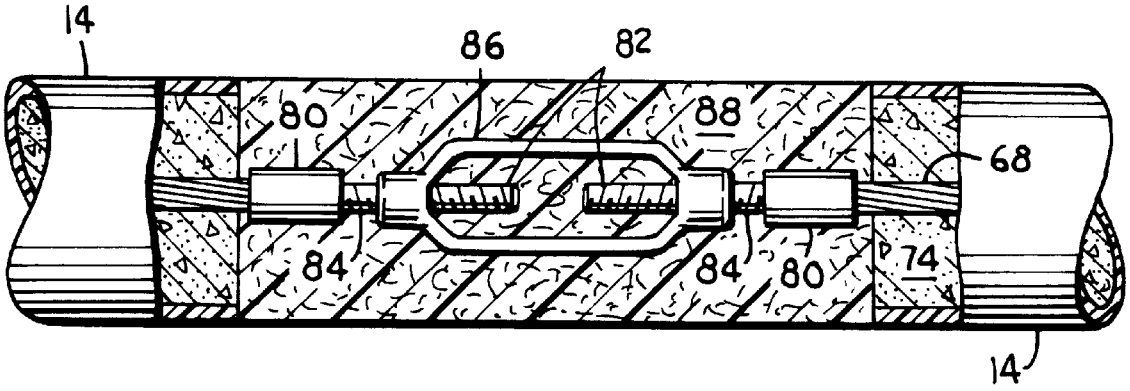
FIG. 14 is an enlarged view of the portion of FIG. 1 encircled by line 14 of FIG. 1.

As best seen in FIGS. 1, 13 and 14, compression members 12 and tension member 14 may be constructed of shorter pieces, connected in series. FIG. 13 illustrates the connection of compression members 12 in series. As shown in FIG. 13, concrete material 74 does not extend completely to the end of body 64, but terminates prior to end 76. The end of each compression member 12 is then fitted with a steel insert 78. As shown in FIG. 13, steel insert 78 thus couples one compression member 12 to the other. Importantly, a gap exists between each 76 of compression members 12. Therefore, body 64 does not carry any axial forces. Alternatively, steel insert 78 could be replaced with a high-strength cementitious material. Steel insert 78 therefore acts to transmit the compressive load from one compression member 12 to the other.

As shown in FIGS. 1 and 14, tension members 14 may also be connected in shorter pieces in series. As best seen in FIG. 14, to couple two tension member 14 together, concrete material 74 is again terminated prior to end 76 of body 64. A coupler 80 is then attached to tendon end 82. Coupler 80 acts to couple a threaded rod 84 to tended end 82. One threaded rod 84 is threaded with left-hand threads, while the opposing threaded rod 84 is threaded with right-hand threads. Opposing threaded rods 84 are then coupled together with a turn buckle 86. Turn buckle 86 may therefore be used to further tension tendons 68. When turn buckle 86 is installed and the desired amount of tension is placed on tendons 68, a cementitious grout 88 is placed around couplers 80, threaded rods 84 and turn buckle 86 to hole the assembly in place. Therefore, it can be seen that both compression members 12 and tension members 14 may be connected in series.

Figure 12:
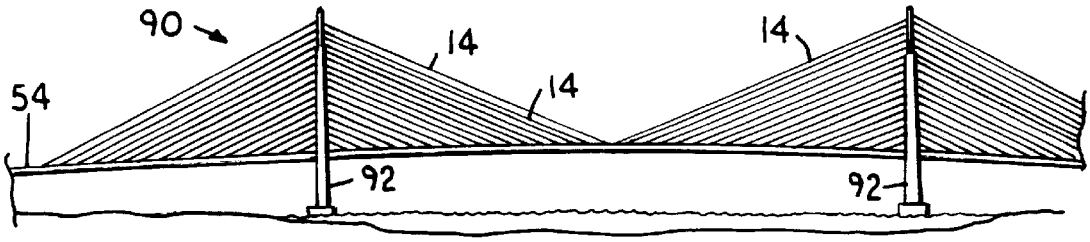
FIG. 12 is a partial elevation view of a cable-stayed bridge utilizing tension members according to the principles of the invention.

Therefore, compression members 12 and tension members 14 can be used to erect a structure, such as an arch bridge, where the load bearing characteristics of the compression and tension members are economically increased. Although an arch bridge is shown in FIG. 1, tension member 14 described above could be used in other bridges and structures as well. One particular use for tension member 14 is as a replacement for the traditional cable stays in a cable-stayed bridge 90, shown in FIG. 12. In this use, tension members 14 are used to support deck 54. Therefore, one end of each tension member 14 is secured to deck 54, and the opposite end is connected to one of a number of vertically oriented concrete pylons 92. In this use, it is preferable to use tension member 14 shown in FIG. 11, with multiple tendons 68. When such a tension member 14 is used in place of the traditional cable-stays on a cable-stay type bridge, the tendons 68 are protected by the concrete, which greatly reduces fatigue due to vibration. Additionally, tension member 14 will be less susceptible to the sagging that is experienced by the cable stays currently in use.

From the foregoing, it will be seen that this invention is one well adapted to obtain all of the ends and objects hereinabove set forth, together with other advantages which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

We claim:

1. A method for forming a tension member for use in erecting a structure, comprising:

providing a hollow, preformed elongated body to a desired length, said body having a first end and a second end, said body forming the outermost perimeter of the tension member;

placing a tendon having opposing terminal ends through said elongated body so that said tendon extends axially within said body;

placing a tension force on said terminal ends of said tendon;

filling said body with concrete so that it surrounds said tendon, said body providing lateral confinement to said concrete;

allowing said concrete to harden within said body and bond with said body and said tendon so that said tendon is prevented from axial movement;

releasing said tension force on said terminal ends of said tendon so that said tension force is held on said tendon by said concrete, said body acting to confine said concrete; and cutting said terminal ends of said tendon after said tension force has been released;

whereby said concrete contacts said tendon to maintain the tension force placed upon said tendon so that the tension member is prestressed to be in compression.

2. The method for forming a tension member of claim 1, further comprising holding said tendon centrally within said body.

3. The method for forming a tension member of claim 2, wherein said body is a hollow cylindrical tube.

4. The method for forming a tension member of claim 3, wherein said body is made from steel.

5. The method for forming a tension member of claim 4, further comprising preventing said concrete from extending beyond said body.

6. A tension member for use in erecting a structure, produced by the method of claim 1.

* * * * *